US005765329A

United States Patent [19]

Huang

[11] Patent Number: 5,765,329

[45] Date of Patent: Jun. 16, 1998

[54] ROOF CONSTRUCTION OF CORRUGATED SHEETS

[76] Inventor: Chihshu Huang, 237 Cherng Ming Street, San Min District, Kaohsiung, Taiwan, China

[21] Appl. No.: 904,294

[22] Filed: Jul. 31, 1997

Related U.S. Application Data

[63] Continuation of Ser. No. 569,263, Dec. 22, 1995, abandoned.

[30] Foreign Application Priority Data

Jun. 28, 1993 [CN] China ..... 93 1 07395.2

[51] Int. Cl.[6] ..... E04B 1/70

[52] U.S. Cl. ..... 52/302.3; 52/198; 52/630; 52/783.14; 52/798.1; 52/799.1; 165/49; 165/57; 454/366; 454/368

[58] Field of Search ..... 52/57, 198, 199, 52/302.1, 302.3, 302.7, 630, 674, 783.1, 783.11, 783.14, 783.15, 783.16, 798.1, 799.1, 799.11; 165/47, 49, 53, 54, 56, 57; 454/339, 365, 366, 367, 368

[56] References Cited

U.S. PATENT DOCUMENTS

| | | | |
|---|---|---|---|
| 1,616,968 | 2/1927 | Hall | 52/630 X |
| 2,852,109 | 9/1958 | Pine | 52/302.3 X |
| 2,931,212 | 4/1960 | Wiesmann | 52/302.3 X |
| 2,936,723 | 5/1960 | Waldron | 52/302.3 X |
| 3,074,339 | 1/1963 | Pennati | 52/302.3 X |
| 3,086,323 | 4/1963 | Pine | 52/302.3 X |
| 3,458,168 | 7/1969 | White | 52/674 X |
| 3,537,378 | 11/1970 | Daly | 52/199 X |
| 4,365,453 | 12/1982 | Lowe | 52/630 X |
| 4,562,678 | 1/1986 | Carroll et al. | 52/302.3 |
| 4,977,714 | 12/1990 | Gregory, Jr. | 52/199 X |

FOREIGN PATENT DOCUMENTS

| | | | |
|---|---|---|---|
| 900329 | 6/1945 | France | 52/674 |
| 2481341 | 10/1981 | France | 52/302.3 |
| 3829408 | 3/1990 | Germany | 52/302.1 |
| 625070 | 9/1961 | Italy | 52/198 |

*Primary Examiner*—Carl D. Friedman
*Assistant Examiner*—Kevin D. Wilkens
*Attorney, Agent, or Firm*—Bacon & Thomas

[57] ABSTRACT

A roof construction includes spaced apart corrugated sheets held in spaced relationship by a plurality of spacers, the corrugated sheets both including apertures for dissipating heat contained in the hot air between the sheets into atmosphere and for guiding hot air from below the lower sheet into the space between the sheets for ultimate expansion and discharge into atmosphere. The apertures may be offset to prevent flow of moisture directly through the apertures and other devices may be utilized to prevent direct flow of moisture into the space below the roof assembly.

4 Claims, 7 Drawing Sheets

ROOF CONSTRUCTION OF CORRUGATED SHEETS

This application is a continuation of application Ser. No. 08/569,263, filed Dec. 22, 1995, now abandoned.

The present invention relates to a roof construction of corrugated sheets.

Nowadays many plants or buildings, temporary or permanent, widely use corrugated sheets made of a wide variety of materials, such as plastics, or plated steel sheet. Because of their low cost, such a sheet becomes very popular either in general residential houses or large plants. However such sheets have a poor heat insulation property. It is mostly used as a shield or cover to guard against wind or rain. To achieve the function of heat insulation, heat radiation or air discharging, other heat insulating materials have to be used, such as wooden scrap board, cane scrap board, or PU polyurethane foam board. In order to withdraw waste gas from the room there is a need to install and use air conditioners or ventilation fans. Such structure therefore consumes additional energy. For a large size plant building, air conditioning costs could be very huge or cannot be economically applicable. In the plant environment, the air quality is usually poor due to heat and dust generated in the production process which cannot be effectively dispelled or discharged out. The insulating materials used can even trap the heat and dust within the building. Therefore in the plant environment, there is usually a protrusive structure built on the roof ridge for skylight installation to enable waste heat and waste gas be drawn out of the plant building. Then the air quality within the room can be improved, and the temperature within the room can be reduced.

Nevertheless such a structure is not very effective for a large plant environment. Ventilation fans are usually needed to be installed to speed the discharging of waste heat and gas. This increases the difficulty of construction work, increases cost and consumes energy.

The construction industry has long been searching for a better insulation method and materials to improve the problems set forth above. However, to the applicant's knowledge, there has been no break through to overcome the problem of poor insulating properties of corrugated sheet.

DISCLOSURE OF THE INVENTION

It is therefore an object of the present invention to provide a roof construction of corrugated sheets which in addition to guarding against wind or rain, can also offer the function of heat insulation, heat radiation and withdrawal of gases.

To accomplish the object set forth above, the roof construction according to the present invention comprises an upper corrugated sheet, a lower corrugated sheet and a plural number of spacers. The spacers are interposed between the two sheets and are transversely disposed against the aligning direction of the peaks and valleys of the corrugated sheets, thus forming an air-flow cavity therebetween. The upper corrugated sheet further has a lot of apertures formed therein for air-flow.

According to the present invention, the lower corrugated sheet may also have apertures formed therein to allow air-flow. The peaks and valleys of the upper and lower corrugated sheets are offset with each other.

The structure and method of the roof construction according to the present invention employ the insulation property of air, the heat exchange theory of air and the air convection theory which enable air to flow upward when heated. The present invention also applies a method used by our ancestors in bygone times, i.e. thatched roofs Thatched roofs allow rainwater to flow downward along the straw without dripping into the room. The heated air or waste gas in the room can flow upward and be withdrawn out of the room through the cracks between the straws.

The present invention adopts the principles set forth above. The roof has an upper sheet and a lower sheet, and has transverse spacers disposed between them to create an airflow cavity. In the upper and lower sheets, there are formed a plural number of apertures in a desired pattern to facilitate air convection. In order to prevent rainwater from leaking into the room through the apertures, the location of the apertures on the upper and lower sheets should be offset. Therefore the heated air and waste gas in the room can be withdrawn out through the apertures in the roof.

When sunshine is present, the air in the air cavity between the upper and lower sheets will be heated, thus inducing an air convection process around the corrugated sheet roof and the surrounding atmosphere, and achieve a heat exchanging effect. The usually sloped surface of the roof can further improve the heat exchanging effect.

In summary, the roof construction according to the present invention uses air as heat exchange medium Air, in the air cavity between the upper and lower corrugated sheets, and in the room and outside the room, when heated, will flow upward, thus generating air convection among the cool and heated air, thereby creating heat insulation, heat radiation and a gas withdrawing effect. The present invention can be applied to any corrugated sheet regardless of its material.

DESCRIPTION OF THE PREFERRED EMBODIMENTS

The present invention employs the insulation property of air, the convection theory of heated air flowing upward and innovative structure in corrugated sheet roofs to induce the convection effect in the air to achieve heat insulation, heat radiation, and a waste heat and waste gas withdrawing effect. The present invention can be applied to any form of corrugated sheet made of any type of material. There is no limitation in the size or shape of the aperture. If it is for heat insulation purposes, the apertures may be dispensed with. The roof can be constructed by two layers of corrugated sheet with spacers interposed between them to form an air cavity therein. The insulation nature of air can then provide a heat insulation effect.

When there are apertures formed in the upper corrugated sheet, then the air convection effect will be induced to enhance the heat insulation effect. When both upper and lower corrugated sheets have apertures formed therein, then the air convection effect can further induce waste gas withdrawal to function in the room.

Figure 1:
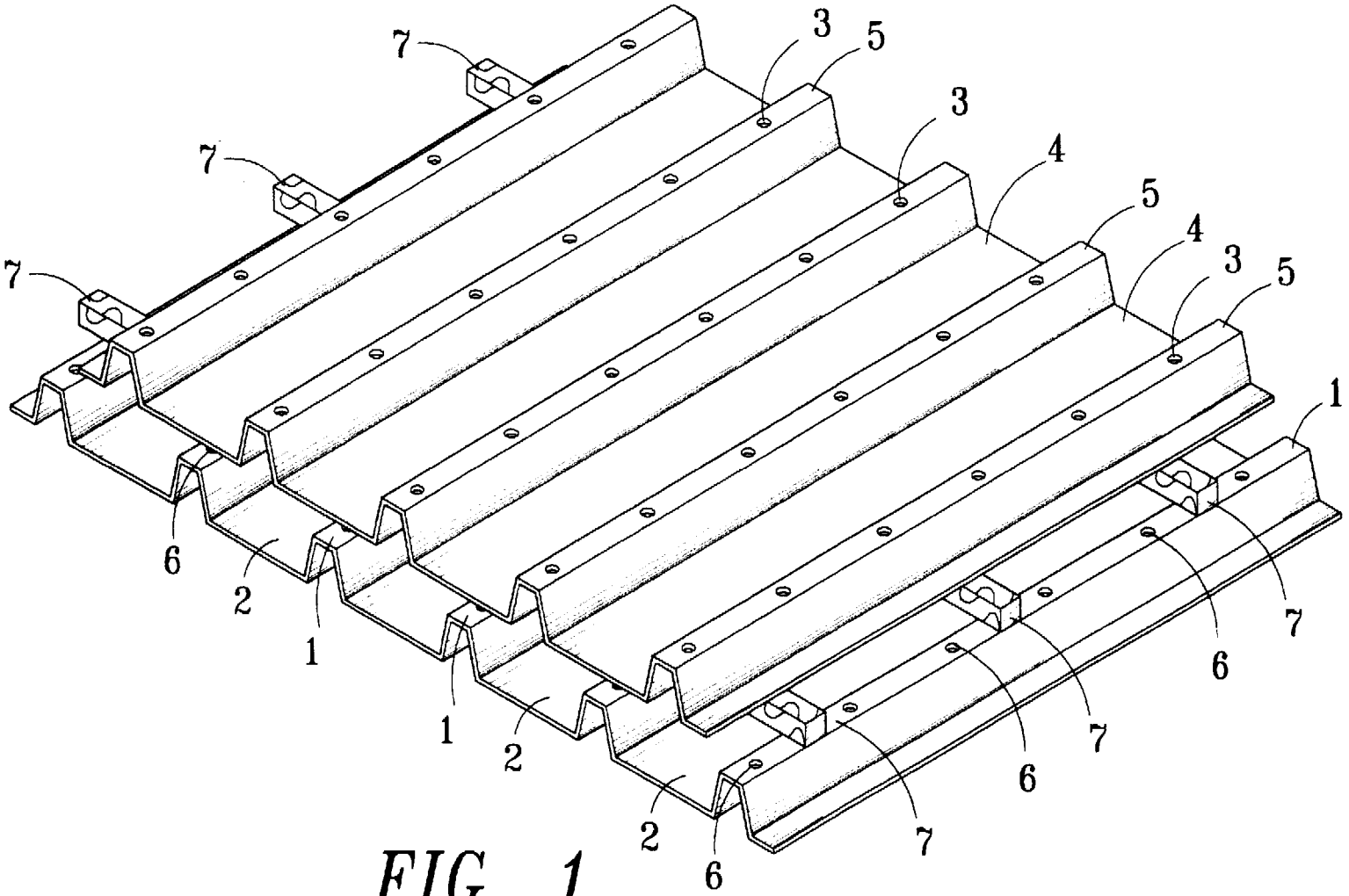
FIG. 1 is a perspective view of an embodiment of a roof construction of corrugated sheets of the present invention.
Figure 2:
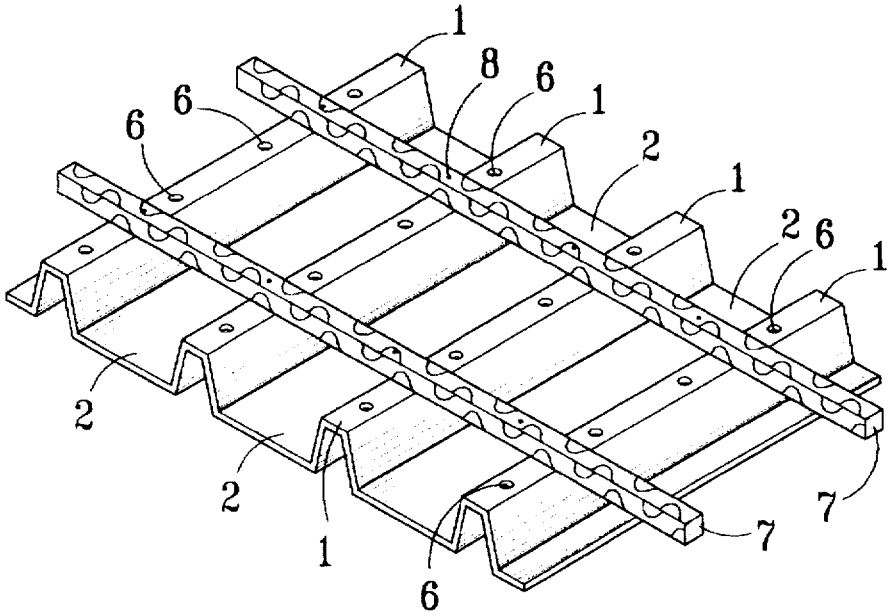
FIG. 2 is a pictorial view of the spacers between two corrugated sheets.

Now referring to FIG. 1 for an embodiment of the present invention, apertures 3, 6 being offset are respectively disposed in the upper and lower sheets. Peak 5 of the upper sheet is located above valley 2 of the lower sheet. Spacer 7 is transversely interposed between the upper and lower sheets to form an air cavity to facilitate air convection. When raining, most rainwater will fall into valleys 4 of the upper sheet and be discharged away. Some rainwater will fall into apertures 6 of the peaks and then drop into the valleys of the lower sheet and be discharged away. Therefore rainwater will not leak into the room Thus the apertures in the roof will not impair the rain-guarding effect.

When there is sunshine, the upper sheet will be heated which in turn warms up air between the upper and lower sheet. As the roof usually has a sloped surface, and the air temperature in the atmosphere above the roof is usually lower than the air trapped between the upper and lower sheet, an air convection effect will be induced to enable heated air in the air cavity to flow out through apertures 3. By the same token, the air in the room below the roof has a higher temperature than the air trapped between the upper and lower sheets. Therefore the convection effect will also occur to enable heated air in the room to flow into air cavity through apertures 6 in the lower sheet, then to flow out into atmosphere through apertures 3 in the upper sheet (refer to FIG. 3 for convection flow). Thus air in the room can be kept fresh, also achieve heat insulation, heat radiation and a waste heat and waste gas withdrawal effect. When the apertures in the upper and lower sheets are formed having a flange facing toward the air cavity, the air convection will perform in a different way (as shown in the arrows in FIG. 4) such as by curling around the flanges of the apertures.

One embodiment of the present invention is to achieve only heat insulation and heat radiation purposes. In such a case, there is no aperture formed in the lower corrugated sheet. The lower sheet is fixed below the spacers by nails or screws like conventional corrugated sheets. The upper corrugated sheet is fixed above the spacers and has apertures pre-formed therein before fixing on the spacers. The size, number and spacing distance of the apertures vary according to the air convection requirements (no aperture formed in the upper sheet can also have a heat insulation effect, although the result will be poorer). Since the lower sheet has no apertures formed therein, rainwater falling down from upper sheet to lower sheet win be discharged away through the gutter without falling into the room Although the aperture is preferably formed on the peak of the upper sheet (shown in FIGS. 1, 2, 3 and 4), it can perform equally well when the aperture is formed on the valley of the upper sheet (shown in FIGS. 5, 6, 7). There is no restrictions in installing the roof construction of the present invention.

When sunshine is available, the upper sheet absorbs heat and transmits it to the air trapped in the air cavity between upper and lower sheets, air temperature in the air cavity will be higher than air temperature in the atmosphere. Because the roof usually has sloping surface, air convection will be induced to enable cool air from the atmosphere to flow into the air cavity from the lower section of the roof and heated air in the cavity will flow out through the apertures in the higher section of the roof thus creating air circulation in the air cavity and resulting in a heat insulation effect.

When the sun sets, air temperature in the atmosphere becomes lower which in turn makes the temperature of the upper sheet to become lower. Air temperature in the air cavity is then higher than that of the upper sheet, and further air convection will take place in the air cavity to lower the temperature of the lower sheet, thus achieving a heat radiation effect.

This method and roof construction can be applied equally will in a general residential house, an office or air-conditioned plant.

Another embodiment of the present invention can achieve the effect of heat insulation, heat radiation and waste gas withdrawal. The upper and lower corrugated sheets are properly perforated before installation. The apertures formed therein should be offset with each other, such that rainwater will not fall from the apertures of the upper sheet to the apertures of the lower sheet, thus preventing rainwater from leaking into the room During installation, the spacers should be first fixed transversely above the lower sheet just like in the first embodiment set forth above, but without the spacers located on the apertures. Then the upper sheet is fixed on the spacers and its apertures can freely communicate with the air cavity formed between the upper and lower sheets. The air convection principle is in general like that of the first embodiment. The heated air in the room or within the plant flows upward and enters into the air cavity between the upper and lower sheets. The merged heated air in the air cavity will then perform an exchange function by convection with the outside atmosphere. Therefore air circulation will be induced in the room, to keep in-room temperature low, the air fresh, and waste heat or polluted air in the room can be withdrawn out to the atmosphere.

There are many advantages of the present invention. Notably, it does not need extra material or equipment. It consumes no energy. Through an innovative design, it can keep the air in the room or plant cool and fresh, maintain good and healthy working environment, thus improve working efficiency and productivity. Upon applying the present invention, an ordinary corrugated sheet material can create multiple effects of shielding rain, heat insulation, heat radiation and gas withdrawal.

The following offers a more detailed description of the embodiments according to the present invention. Referring to FIG. 1 for an embodiment of construction method of two corrugated sheets. Apertures 3 and 6 are formed respectively on the peak of the upper and lower sheets. The upper and lower corrugated sheet are offset with each other with the peak 5 of the upper sheet located above the valley 2 of the lower sheet; and the valley 4 of the upper sheet above the peak of the lower sheet. Spacer 7 is interposed between the upper and lower sheets thus creating a layer of an air cavity between them to facilitate air convection. Spacers 7 are transversely disposed against the peak and valley alignment directions. Corrugated sheets are fixed on the spacers by nails or screws 8. On rainy days, most rainwater will be discharged away through valley 4. A small portion of rainwater might fall through apertures 3 on the peak to the lower sheet.

Since the peak 5 of the upper sheet is located above the valley 2 of the lower sheet, rainwater falling in the valley 2 of the lower sheet will also be discharged away, and thus will not leak into the room through the aperture 6 of the lower sheet. Therefore the apertures in the corrugated sheet do not impair the rain shielding effect.

Figure 3:
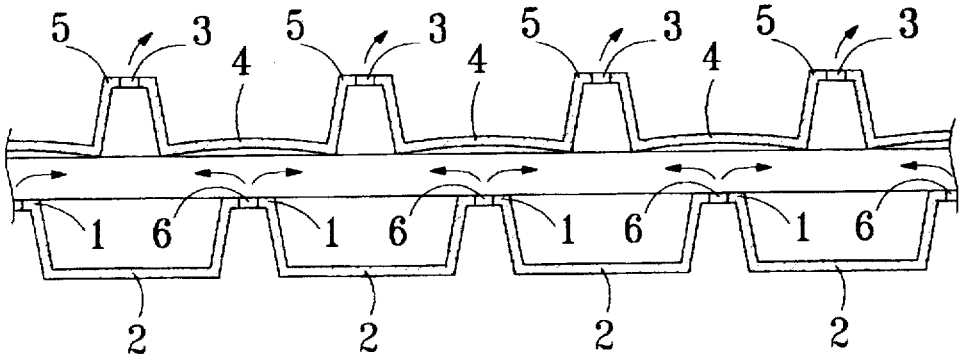
FIG. 3 is a side sectional view of FIG. 1.
Figure 4:
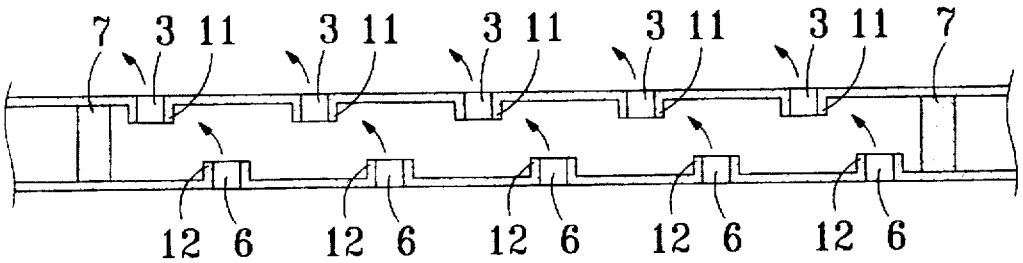
FIG. 4 is a longitudinal section view of a roof construction of corrugated sheets.

When sunshine falls on the roof, the upper sheet temperature will go up first, and the air in the air cavity between the upper and lower sheets will also be heated and go up higher than the atmospheric temperature. As the corrugated sheets are disposed to be inclined over the roof, an air flow will be induced such that the relatively cool air in the atmosphere and the heated air flowing out from the air cavity through apertures 3 will result in a convection effect. In the meantime, the heated air in the room and the air in the air cavity between the upper and lower sheets will also undergo convection process. Thus heated air in the room will flow into the air cavity through apertures 6 of the lower sheet and then flow out into atmosphere through apertures 3 of the upper sheet, and result in continuous air circulation. FIG. 3 illustrates such a convection process. Therefore the air in the room or plant under the roof can be kept fresh, and achieve heat insulation, heat radiation and a gas withdrawal effect.

Figure 5:
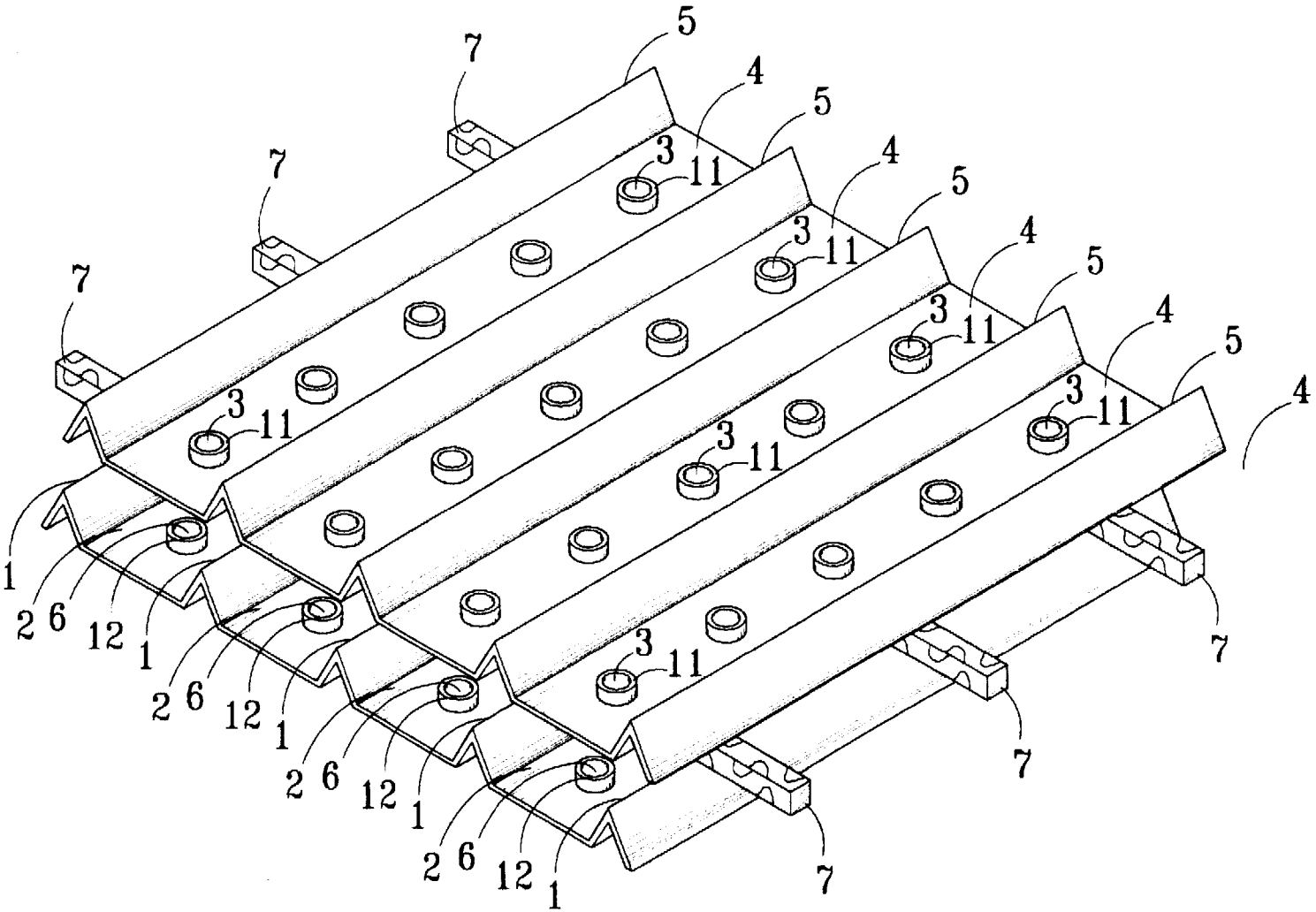
FIG. 5 is a perspective view of another embodiment of a roof construction of corrugated sheets.
Figure 6:
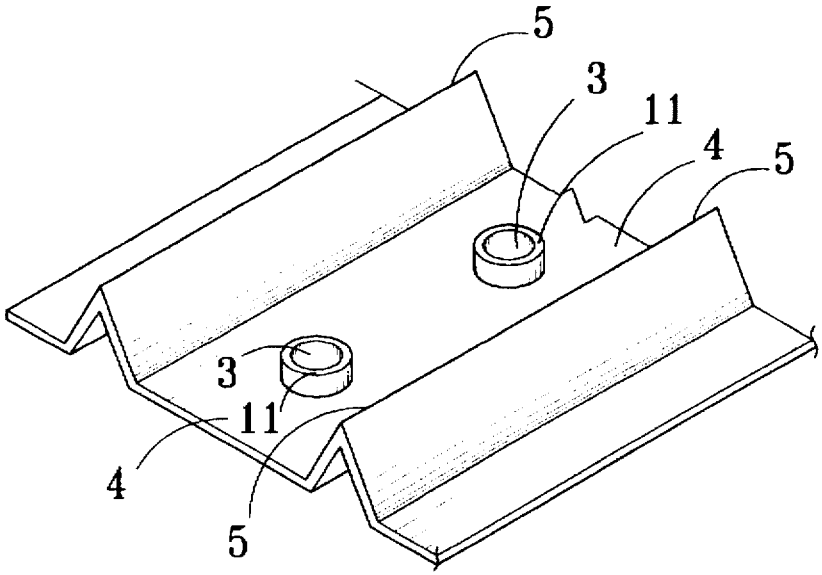
FIG. 6 is a fragmentary enlarged view of FIG. 5.
Figure 7:
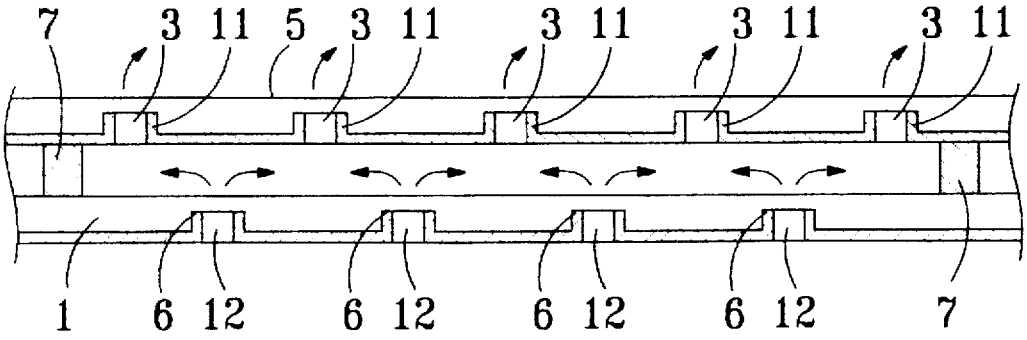
FIG. 7 is a longitudinal section view of a roof construction of corrugated sheet of FIG. 5.

FIGS. 5, 6, and 7 illustrate another embodiment of the present invention. The apertures 3 and 6 are disposed in the valleys 2 and 4 of the corrugated sheets to induce air convection. There are upward annular flanges 11 and 12 formed around the apertures to prevent water from leaking through the apertures.

Figure 8:
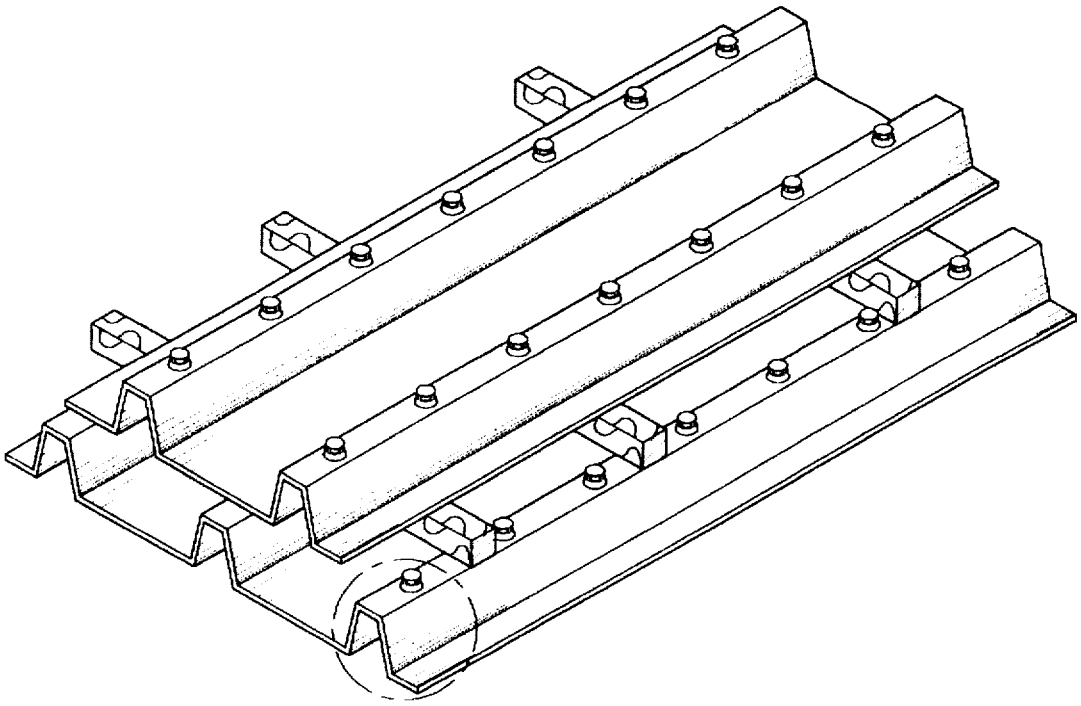
FIG. 8 is a perspective view of a further embodiment of a roof construction of corrugated sheets.
Figure 9:
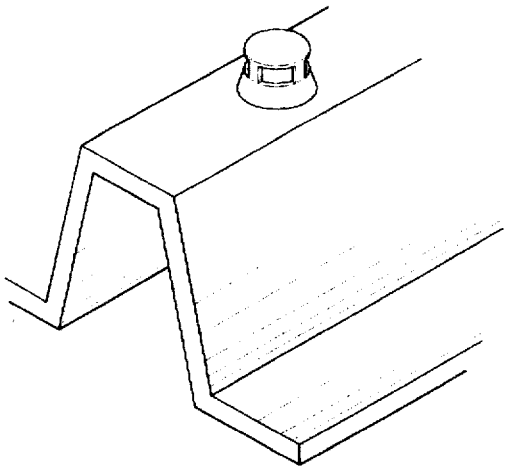
FIG. 9 is a fragmentary enlarged view of corrugated sheet of FIG. 8.
Figure 10:
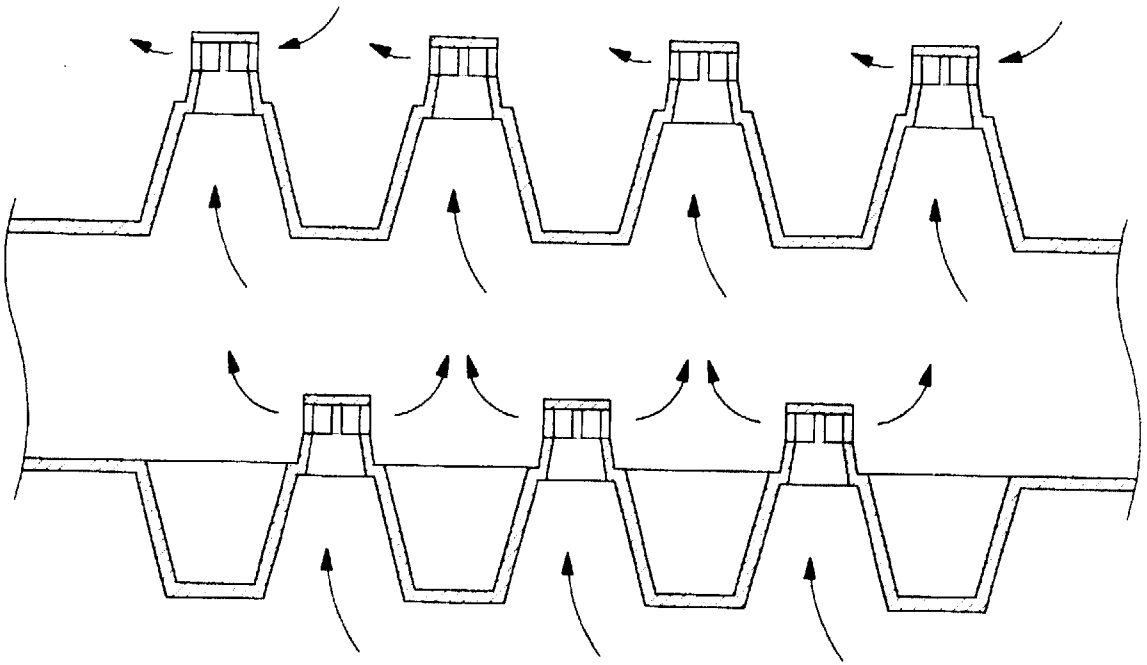
FIG. 10 is a side sectional view of corrugated sheets of FIG. 8.

FIGS. 8, 9, and 10 illustrate a further embodiment of the present invention. There is a cap provided over each aperture. Each cap has a cover on the top and has opening in the lateral wall, thus prevent rainwater from flowing into the aperture while allowing air flow freely therethrough.

Figure 11:
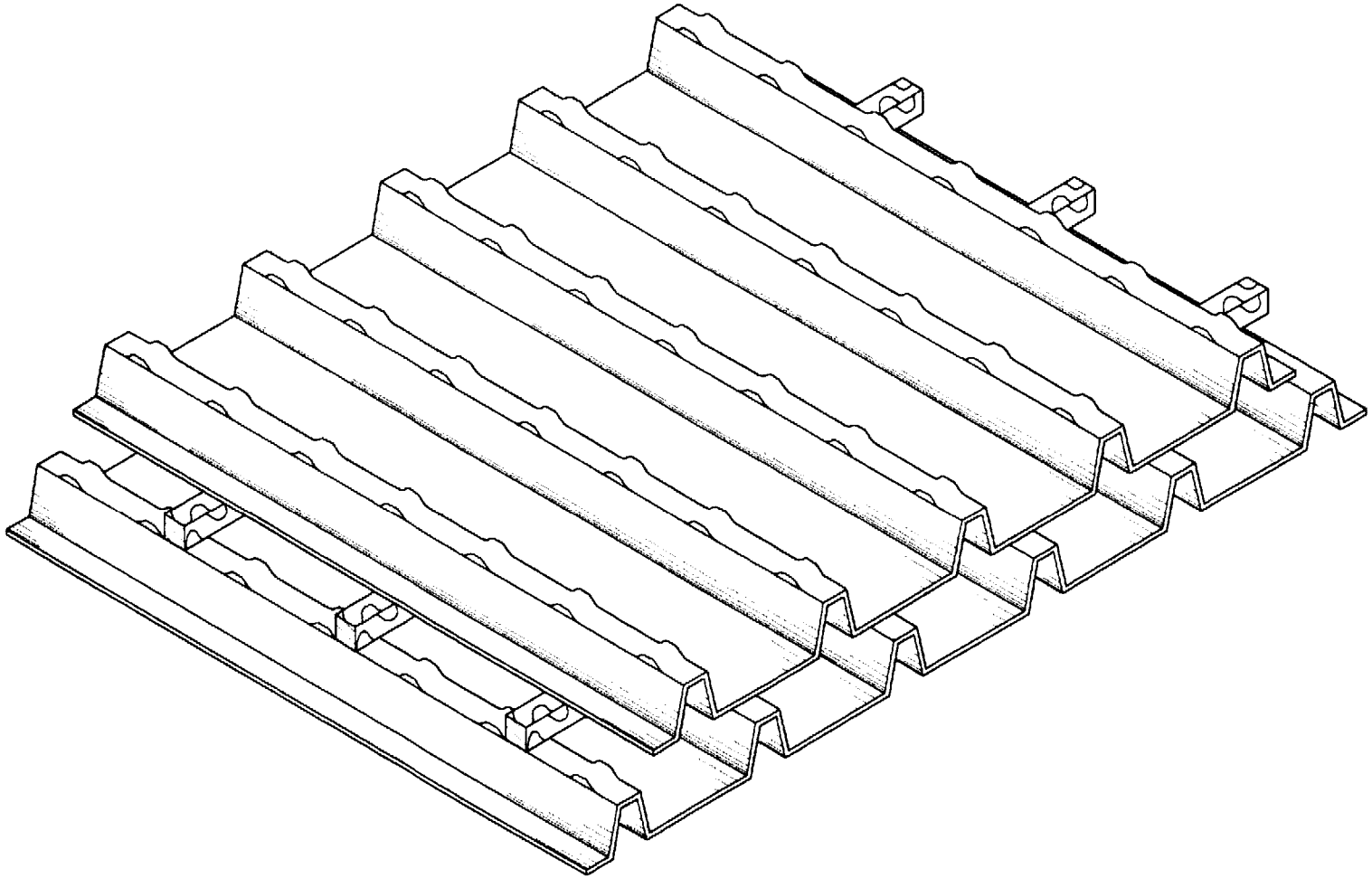
FIG. 11 is a perspective view of yet another embodiment of a roof construction of corrugated sheets.

FIG. 11 illustrates yet another embodiment of the present invention. The peak portion of the corrugated sheet has a trapezoid or rectangular cross section. The top surface of the peak has spaced wave-like bulges. There is an opening formed on the lateral wall at each bulge to allow air flow while preventing rainwater from leaking into the room below the roof Such a structure allows the corrugated sheet be integrally formed without a separate stamping process for creating opening.

It is to be understood that the descriptions and preferred embodiments set forth above only serve for illustrative purposes, and are not intended to limit the scope of the present invention. Various changes and modifications may be made without departing from the scope of the present invention. Accordingly, the specific scope of the present invention is defined only by the following claims which are further exemplary of the present invention.

I claim:

1. A roof construction comprising:

a first corrugated sheet and a second corrugated sheet disposed below said first corrugated sheet;

a plurality of spacers separating said first and second corrugated sheets to provide an airflow cavity therebetween, said plurality of spacers being disposed transversely to directions of corrugation of said first and second corrugated sheets;

a heat exchange means formed directly in said first and second corrugated sheets for dissipating any heat contained in any hot air located between said first and second corrugated sheets into atmosphere by said first corrugated sheet and for guiding any hot expanded air upwardly from below said second corrugated sheet to flow between said first and second corrugated sheets and to be ultimately discharged into the atmosphere;

wherein said heat exchange means includes a first plurality of apertures disposed in said first corrugated sheet and a second plurality of apertures disposed in said second corrugated sheet;

wherein each of said apertures has an annular flange disposed around the aperture; and wherein a cap is disposed in each of the annular flanges to cover the top of the aperture, said cap having openings on lateral walls to allow air flow.

2. A roof construction comprising:

a first corrugated sheet and a second corrugated sheet disposed below said first corrugated sheet;

a plurality of spacers separating said first and second corrugated sheets to provide an airflow cavity therebetween, said plurality of spacers being disposed transversely to directions of corrugation of said first and second corrugated sheets;

a heat exchange means formed directly in said first and second corrugated sheets for dissipating any heat contained in any hot air located between said first and second corrugated sheets into atmosphere by said first corrugated sheet and for guiding any hot expanded air upwardly from below said second corrugated sheet to flow between said first and second corrugated sheets and to be ultimately discharged into the atmosphere;

wherein said heat exchange means includes a first plurality of apertures disposed in said first corrugated sheet and a second plurality of apertures disposed in said second corrugated sheet; and wherein said first and second corrugated sheets have a plurality of peak and valley corrugations, and wherein the peaks of the first and second corrugations have a plurality of upwardly protrusive bulges, said apertures being disposed on lateral walls of the bulges.

3. A roof construction comprising:

a first corrugated sheet and a second corrugated sheet disposed below said first corrugated sheet, said first and second corrugated sheets having a plurality of peak and valley corrugations;

a plurality of spacers separating said first and second corrugated sheets to provide an airflow cavity therebetween, said plurality of spacers being disposed transversely to directions of corrugation of said first and second corrugated sheets;

a heat exchange means formed directly in said first and second corrugated sheets for dissipating any heat contained in any hot air located between said first and second corrugated sheets into atmosphere by said first corrugated sheet and for guiding any hot expanded air upwardly from below said second corrugated sheet to flow between said first and second corrugated sheets and to be ultimately discharged into the atmosphere;

wherein said heat exchange means includes a first plurality of apertures disposed in said first corrugated sheet and a second plurality of apertures disposed in said second corrugated sheet, and wherein both said first plurality of apertures and said second plurality of apertures are disposed on said valleys of said first and second corrugated sheets, and wherein an annular flange is disposed around each aperture of said first and second plurality of apertures; and wherein a cap is disposed on each of the annular flanges to cover the top of the apertures, said cap having openings on lateral walls to allow air flow.

4. A roof construction comprising:

a first corrugated sheet and a second corrugated sheet disposed below said first corrugated sheet, wherein said first and second corrugated sheets have a plurality of peak and valley corrugations;

a plurality of spacers separating said first and second corrugated sheets to provide an airflow cavity therebetween, said plurality of spacers being disposed transversely to directions of corrugation of said first and second corrugated sheets;

a heat exchange means formed directly in said first and second corrugated sheets for dissipating any heat contained in hot air between said first and second corrugated sheets into atmosphere by said first corrugated sheet and for guiding hot expanded air upwardly from below said second corrugated sheet to flow between said first and second corrugated sheets and to be ultimately discharged into the atmosphere;

wherein said heat exchange means includes a first plurality of apertures disposed in said first corrugated sheet and a second plurality of apertures disposed in said second corrugated sheet, and wherein both said first plurality of apertures and said second plurality of apertures are disposed on said peaks of said first and second corrugated sheets; and wherein the peaks of the first and second corrugated sheets have a plurality of upwardly protrusive bulges, and wherein said apertures are disposed on lateral walls of the bulges.

* * * * *